US010766574B2

(12) United States Patent
Cadalen et al.

(10) Patent No.: US 10,766,574 B2
(45) Date of Patent: Sep. 8, 2020

(54) AUTOMATIC-OPENING FAIRLEAD AND TOWING DEVICE COMPRISING THE FAIRLEAD

(71) Applicant: THALES, Courbevoie (FR)

(72) Inventors: François Cadalen, Brest (FR); Olivier Cosson, Brest (FR); Pierre Hofmann, Brest (FR)

(73) Assignee: THALES, Courbevoie (FR)

( * ) Notice: Subject to any disclaimer, the term of this patent is extended or adjusted under 35 U.S.C. 154(b) by 0 days.

(21) Appl. No.: 16/340,093

(22) PCT Filed: Oct. 3, 2017

(86) PCT No.: PCT/EP2017/075034
§ 371 (c)(1),
(2) Date: Apr. 5, 2019

(87) PCT Pub. No.: WO2018/065385
PCT Pub. Date: Apr. 12, 2018

(65) Prior Publication Data

US 2020/0047853 A1 Feb. 13, 2020

(30) Foreign Application Priority Data

Oct. 6, 2016 (FR) ..... 16 01450

(51) Int. Cl.
*B63B 21/04* (2006.01)
*B63B 21/56* (2006.01)
(Continued)

(52) U.S. Cl.
CPC ..... *B63B 21/10* (2013.01); *B63B 21/16* (2013.01); *B63B 21/663* (2013.01)

(58) Field of Classification Search
CPC ..... B63B 21/04; B63B 21/10; B63B 21/16; B63B 21/18; B63B 21/20; B63B 21/56;
(Continued)

(56) References Cited

U.S. PATENT DOCUMENTS 3,347,526 A 10/1967 Thomas et al.
4,597,352 A * 7/1986 Norminton ..... B63G 8/42 114/254
(Continued)

FOREIGN PATENT DOCUMENTS

GB 1 522 131 A 8/1978
JP 2001-354189 A 12/2001
(Continued)

*Primary Examiner* — Daniel V Venne
(74) *Attorney, Agent, or Firm* — Baker & Hostetler LLP

(57) ABSTRACT

A fairlead that is intended to equip a towing device that can be installed on the deck of a ship and includes a winch, a cable passing through the fairlead under the action of the winch, the fairlead comprising: an open-section channel extending in a main direction for guiding the cable, a movable bolt closing a section of the channel, a force sensor that is situated in front of the bolt in one sense of the main direction and is configured to detect an external force, and a trigger configured to open the bolt when a force exerted on the sensor and oriented along the main axis in the sense exceeds a predetermined force, and to close the bolt when this force ceases.

14 Claims, 10 Drawing Sheets

(51) Int. Cl.
*B63B 21/10* (2006.01)
*B63B 21/16* (2006.01)
*B63B 21/66* (2006.01)

(58) Field of Classification Search
CPC ..... B63B 21/566; B63B 21/58; B63B 21/60; B63B 21/66; B63B 21/663; B63B 2021/003; B63B 2021/004
USPC ..... 114/242, 243, 247, 249, 252, 253, 254
See application file for complete search history.

(56) References Cited

U.S. PATENT DOCUMENTS

| | | | | |
|---|---|---|---|---|
| 4,658,750 | A | 4/1987 | Malcosky | |
| 8,087,372 | B1 * | 1/2012 | Ruffa | B23D 29/002 114/254 |
| 9,611,012 | B2 * | 4/2017 | Lin | B63B 21/10 |
| 9,682,749 | B2 * | 6/2017 | Borel | B63B 21/10 |

FOREIGN PATENT DOCUMENTS

| | | | |
|---|---|---|---|
| WO | 2013/068497 | A1 | 5/2013 |
| WO | 2015/014886 | A1 | 2/2015 |

* cited by examiner

AUTOMATIC-OPENING FAIRLEAD AND TOWING DEVICE COMPRISING THE FAIRLEAD

CROSS-REFERENCE TO RELATED APPLICATIONS

This application is a National Stage of International patent application PCT/EP2017/075034, filed on Oct. 3, 2017, which claims priority to foreign French patent application No. FR 1601450, filed on Oct. 6, 2016, the disclosures of which are incorporated by reference in their entirety.

FIELD OF THE INVENTION

The invention relates to a fairlead that is intended to equip a towing device that can be installed on the deck of a ship and makes it possible to tow an object trailed behind the ship. The towing device conventionally comprises a winch, a cable and a fairlead, the cable passing through the fairlead under the action of the winch. This type of device is employed for example in the field of underwater acoustics and more particular for towed active sonars. These sonars generally comprise a transmission antenna integrated into a submersible object or "towfish" and a receiving antenna made up of a linear antenna or "streamer". During the use of the sonar being towed, the towfish and the streamer are secured to the same cable in order to be towed by the ship.

BACKGROUND

It is possible to use the sonar in passive mode, i.e. without its transmission antenna, or in active mode with its transmission antenna formed by the towfish and its receiving antenna. In order to ensure these two operating modes, the towfish is fixed and connected removably to the cable. When the towfish is in place on the cable, it is suspended from the cable such that its center of gravity is situated under the axis of the cable. The towfish comprises a body and one or two arms. The free end of each arm is coupled to the cable from above the cable in order to allow the cable to be guided through the fairlead.

The cable generally comprises a core formed of electrical and/or optical conductors for transmitting energy and information between the equipment of the sonar that are situated on board the ship and the antennas. The core of the cable is generally covered with a strand of metal wires that ensure the mechanical integrity of the cable. The make-up of the cable imposes a minimum radius of curvature thereon. Below this radius, inadmissible mechanical stresses arise and cause the constituents of the cable to deteriorate. The winch fixed to the deck of the ship has a reel on which the cable can be hauled in when the sonar is inactive and when the antennas are stowed on board the ship. The diameter of the reel makes it possible to ensure that the hauled-in elements are not curved at a radius smaller than the minimum radius of curvature.

When the towed elements are in the sea, the cable is guided by the fairlead, which makes it possible to safeguard its effective radius of curvature. The fairlead forms the last element for guiding the cable with respect to the ship before the cable drops into the water. The fairlead comprises a frame fixed to the deck of the ship and a channel in which the cable slides. The channel has an upwardly open section such that the cable is held in the channel by gravity. When the sea is heavy or while the ship is being maneuvered, the cable can escape from the channel, the fairlead then no longer fulfilling its guiding role. In order to prevent the cable from escaping from the channel, it is desirable to close at least a section of the channel. However, the fact of closing the channel prevents the arms of the towfish from passing through the fairlead.

The applicant has attempted to internally produce a fairlead having a closed section that an operator can open manually to allow the arms of the towfish through. The position of the fairlead behind the ship, or partially overhanging the transom of the ship makes the opening and closing operation tricky or even dangerous under difficult navigation conditions. It would be conceivable to remote-control the opening and closing of the fairlead, but this would be complicated to implement. Furthermore, the towing device already requires an operator manipulating the winch. If this operator had to move around in order to open the fairlead, this would entail the risk of the fairlead being left open for an excessively long time. A second operator could manipulate the fairlead, but this would generate a higher operating cost for the towing device.

The invention provides a solution to this problem by proposing a fairlead with a closed channel that can open automatically during the passage of the towfish.

SUMMARY OF THE INVENTION

To this end, the subject of the invention is a fairlead that is intended to equip a towing device that can be installed on the deck of a ship and comprises a winch, a cable passing through the fairlead under the action of the winch, the fairlead comprising:

- an open-section channel extending in a main direction for guiding the cable,
- a movable bolt closing a section of the channel,
- a force sensor that is situated in front of the bolt in one sense of the main direction and is configured to detect an external force, and
- a trigger configured to open the bolt when a force exerted on the sensor and oriented along the main axis in the sense exceeds a predetermined force, and to close the bolt when this force ceases.

Advantageously, the force sensor is configured to detect an external force in front of the bolt in both senses of the main direction, and the trigger is configured to open the bolt when a force exerted on the sensor and oriented along the main axis in both senses exceeds the predetermined force, and to close the bolt when this force ceases.

According to a first embodiment of the invention, the bolt is rotatable with respect to the channel about an axis of rotation substantially perpendicular to the main direction.

Advantageously, according to the first embodiment, the force sensor comprises a tab that is rotatable about the axis of rotation. The trigger comprises a pawl that can take up two positions, of which a first position, referred to as the closed position, is effective when there is no force on the tab and keeps the bolt closed, and of which a second position, referred to as the open position, allows the bolt to rotate freely. The pawl is driven by the tab from the closed position to the open position after the predetermined force has been exceeded, the fairlead also comprising a first spring connected between the channel and the tab, the spring stiffness of the spring contributing to the predetermined force and to the realignment of the bolt with the tab.

The first spring may be preloaded, the preload contributing to the predetermined force and to the realignment of the bolt with the tab.

Advantageously, according to the first embodiment, the trigger of the fairlead includes a second spring. The second spring being configured such that it tends to close the bolt. Additionally, the second spring being connected in series with the first spring. The bolt is secured at a common point between the first spring and the second spring.

The second spring advantageously has a spring stiffness or a spring constant that is less than a spring stiffness or a spring constant of the first spring.

The second spring may be preloaded by a value or force that is less than a preloaded value or force of the first spring.

According to a second embodiment of the invention, the bolt of the fairlead is movable. In particular, the bolt is movable in translation with respect to the channel along an axis that is substantially perpendicular to the main direction.

Advantageously, according to the second embodiment, the force sensor comprises a tab. The tab is configured to be rotatable about an axis of rotation substantially perpendicular to the main direction. Additionally, the force sensor includes a means for converting a rotary movement of the tab into a movement in translation of the bolt. The means for converting can advantageously be configured and structured for irreversible operation.

Advantageously, the fairlead of the second embodiment comprises a cam. The cam can be configured and arranged such that it turns with the tab. The fairlead of the second embodiment further comprises a pivoting lever comprising, arranged at a distance from its pivot axis, a pin bearing on the cam and a slot in which the bolt is supported.

The fairlead advantageously comprises a return spring that tends to return the cam into a balanced position in which the bolt is closed.

A further subject of the invention is a towing device that can be installed on the deck of a ship and comprises a winch, a cable and a fairlead according to the invention, the fairlead and the winch being fixed with respect to one another.

BRIEF DESCRIPTION OF THE DRAWINGS

The invention will be understood better and further advantages will become apparent from reading the detailed description of an embodiment given by way of example, said description being illustrated by the appended drawing, in which.

For the sake of clarity, the same elements will bear the same references in the different figures.

DETAILED DESCRIPTION

The invention is described with reference to the towing of a sonar by a surface vessel. It will of course be understood that the invention can be implemented for other towed elements.

Figure 1:
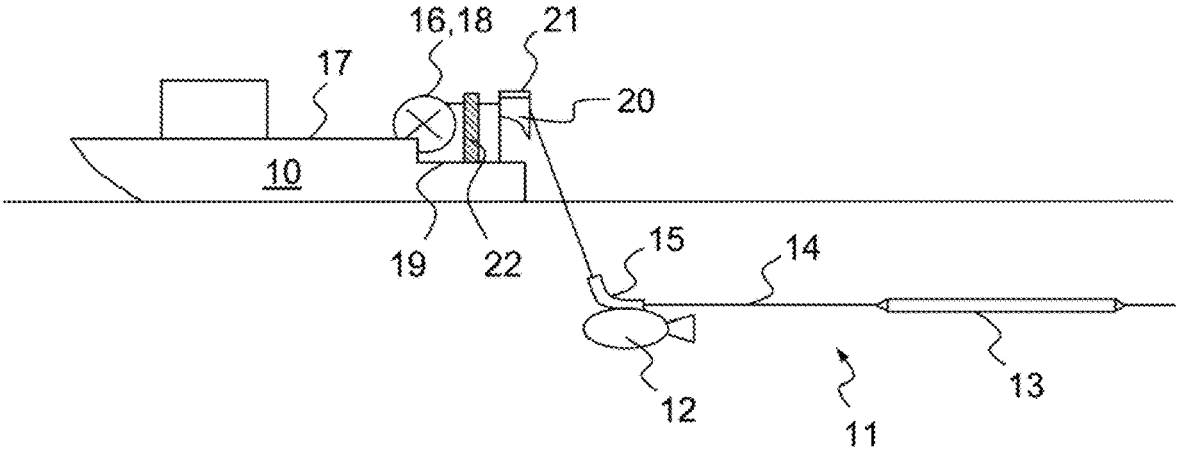
FIG. 1 schematically shows a ship towing an active sonar.

FIG. 1 shows a ship 10 towing an active sonar 11 comprising an acoustic transmission antenna 12, often referred to as a towfish, and an acoustic receiving antenna 13, often referred to as a streamer. The sonar 11 also comprises a cable 14 for towing the two antennas 12 and 13. The cable 14 also carries signals and power between the ship 10 and the antennas 12 and 13 of the sonar 11.

The antennas 12 and 13 are mechanically anchored and connected electrically and/or optically to the cable 14 in an appropriate manner. Conventionally, the receiving antenna 13 is formed by a tubular linear antenna identical to those found in passive sonars, hence its name of streamer, while the transmission antenna 12 is incorporated into a voluminous structure having a shape similar to that of a fish. The receiving streamer is generally disposed at the rear, at the end of the cable 14, the towfish being positioned on the part of the cable 14 closest to the ship 10. During an underwater acoustic mission, the antenna 12 transmits sound waves through the water and the receiving antenna 13 picks up any echoes coming from targets at which the sound waves output by the antenna 12 are reflected.

The receiving antenna 13 is generally anchored permanently to the cable 14 while, for its part, the towfish 12 is anchored in a removable manner. To this end, the cable 14 has an anchoring zone 15 for the towfish 12, in which zone means for mechanically fixing the towfish 12 and for electrically and/or optically connecting it to the cable 14 are installed.

The launching and retrieval of the antennas 12 and 13 are realized by means of a winch 16 disposed on a deck 17 of the ship 10. The winch 16 comprises a reel 18 dimensioned to allow the cable 14 and the receiving antenna 13 to be hauled in. The winch 16 also comprises a stand. The reel 18 turns with respect to the stand in order to haul in the cable. The hauling in of the cable 14 makes it possible to winch the towfish 12 on board the ship 10, for example onto an aft platform 19 provided for this purpose.

A fairlead 20 guides the cable 14 downstream of the reel 18. The fairlead 20 forms the last guiding element for the cable 14 before it drops into the water. During towing, the inclination of the cable 14 can vary with respect to the longitudinal axis of the ship 10. The variations in inclination are caused in particular by changes in the heading and speed of the ship and also by the state of the sea. One of the functions of the fairlead 20 is to ensure that the respective radii of curvature of the cable 14 and of the linear antenna do not exceed a predefined lower limit. The cable 14 comprises for example a core formed of electrical and/or optical conductors for transmitting energy and information between the sonar equipment situated on board the ship 10 and the antennas 12 and 13. The core of the cable 14 is generally covered with a strand of metal wires that ensure the mechanical integrity of the cable 14 notably the tensile strength thereof. Below the lower limit of curvature, there is a risk of permanent deformations or breakage of constituents of the cable 14. The same goes for the linear antenna.

Figure 2:
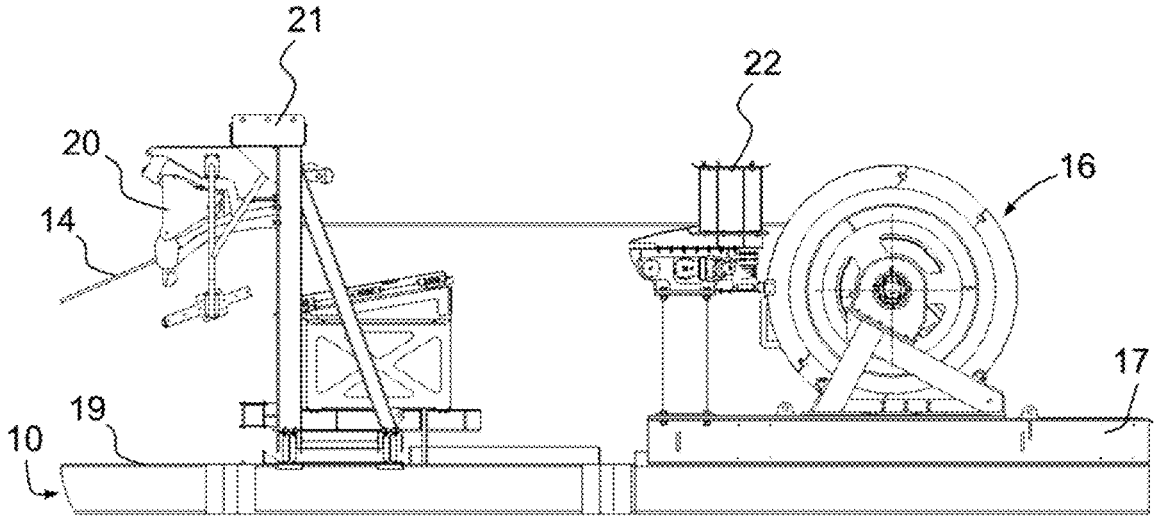
FIG. 2 shows more precisely a towing device fixed to the deck of the ship.

FIG. 2 shows in more detail a side view (from the starboard side) of the elements of the towing device. The fairlead 20 comprises a frame 21 intended to be fixed to a deck 19 of the ship, on the sea side with respect to the winch 16. The deck 19 is in this case an aft platform of the ship 10. In other words, the fairlead 20 is fixed towards the rear of the ship 10 with respect to the winch 16. In the embodiment in the figures, the fairlead 20 and the winch are not fixed to the same deck but could, alternatively, be disposed on the same deck. A reeling device 22 for correctly stowing the cable 14 on the reel 18 is interposed between the winch 16 and the fairlead 20. The cable 14 is in this case guided by the reeling device 22 between the fairlead 20 and the winch 16. Alternatively, the frame 21 is secured to a reeling system 22. In other words, the frame 21 is fixed to a reeling device intended to effect movements in translation parallel to the axis of rotation of the reel 18 in order to correctly stow the cable 14 on the reel 18. When the frame 21 is fixed to the reeling system 22, it is the entire fairlead 20 which effects the movements in translation parallel to the axis of the reel 18 in order to correctly stow the cable 14 on the reel 18.

On the sea side, the cable 14 can oscillate depending on the state of the sea or more simply if the heading of the ship changes. To this end, the fairlead 20 can comprise a plurality of mutually articulated sectors, each for guiding the cable 14. Such a fairlead is described for example in the patent application WO 2015/014886 A1 filed in the name of the applicant. In that document, the axis of the articulation of the sectors intersects the main axis along which the cable extends. It is possible to dispose the axis of rotation of the articulation of the sectors differently, as described for example in the document WO 2013/068497 A1, likewise filed in the name of the applicant. It is of course possible to implement the invention in a fairlead that comprises only a single sector that is fixed to the frame 21 or is rotatable with respect thereto.

Figure 3:
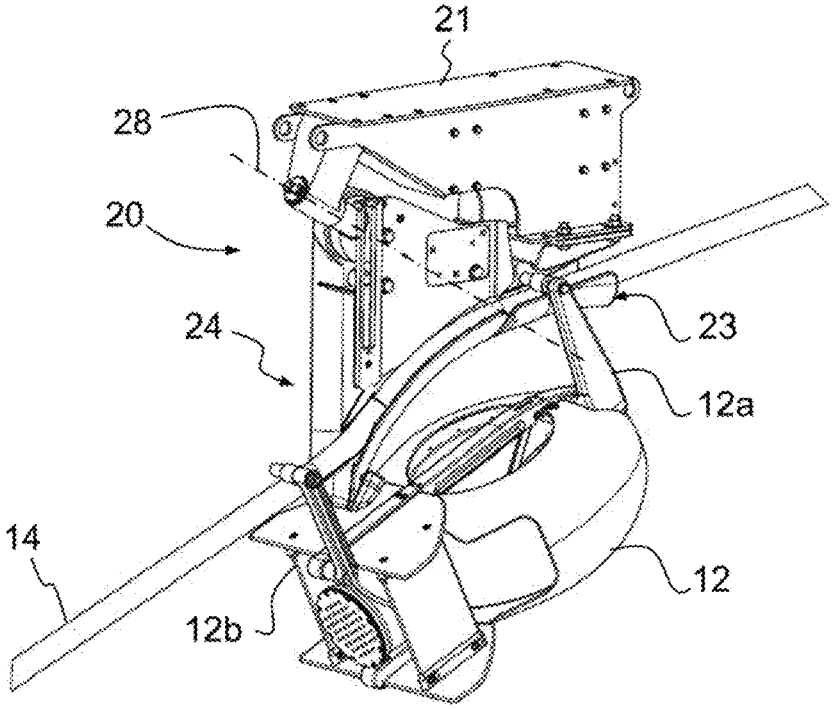
FIG. 3 shows a fairlead through which a towfish is passing.

FIG. 3 shows the fairlead 20 through which the towfish 12 is passing. The towfish 12 comprises two arms 12*a* and 12*b* for coupling to the cable 14.

The fairlead 20 comprises a first sector 23 that is fixed with respect to the frame 21, and a second sector 24 referred to as pivoting sector, both of which guide the cable 14. Each of the sectors 23, 24 comprises a channel or groove, 25 for the sector 23, 26 for the sector 24. The cable 14 slides in the channels 25 and 26, which are substantially in line with one another so as to be able to guide the cable 14 along the entire length of the fairlead 20. Each of the channels 25 and 26 allows the cable 14 to be curved. The channels 25 and 26 are dimensioned and arranged so as to limit the maximum curvature of the cable 14 to a predetermined curvature. The sectors 23 and 24 are mutually articulated. The sector 24 can pivot about an axis 28 with respect to the sector 23. The minimum radius of curvature is maintained during the rotary movements of the sector 24 with respect to the sector 23.

The sectors 23 and 24 have sections in the shape of the letter C making it possible to guide the cable in the bottom part of the C and more specifically in the channels 25 and 26. The opening of the C allows the arms 12*a* and 12*b* of the towfish 12 to pass through. In order to prevent any escape of the cable 14 from the fairlead 20 during unintentional movements of the cable 14, the open side of the fairlead 20 comprises at least one closed section. According to the invention, this closed section opens and closes automatically during the passage of the arms 12*a* and 12*b*.

Figure 4:
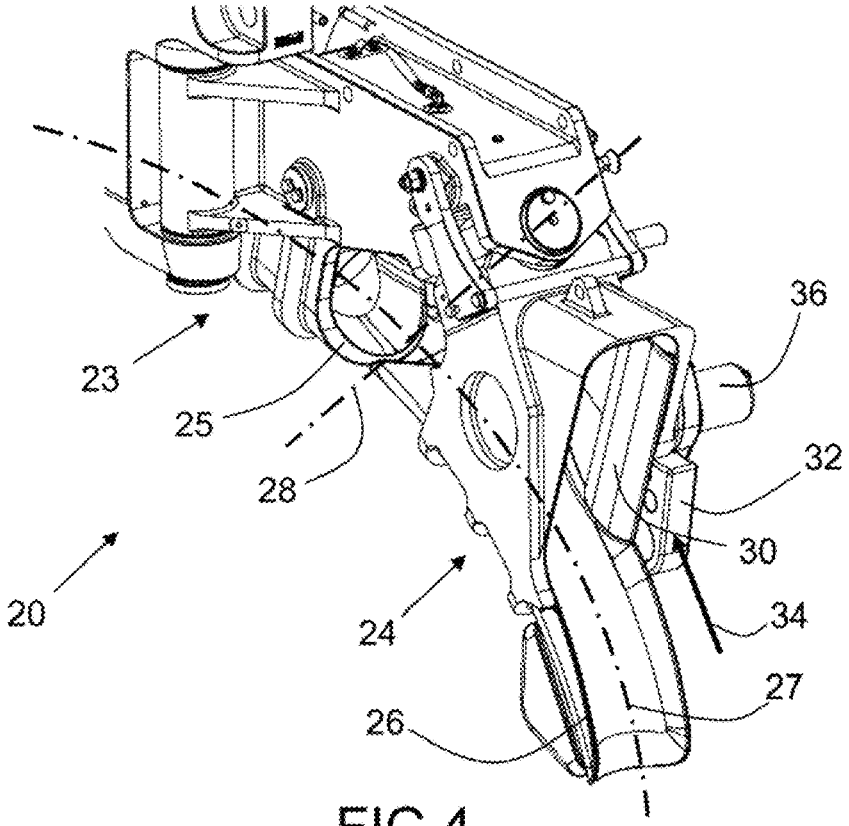
FIG. 4 shows a perspective view of a first embodiment of a mechanism for automatically opening the fairlead.

FIG. 4 shows a perspective view of a first embodiment of a mechanism for automatically opening the fairlead 20. The two channels 23 and 24 extend in a main direction 27 which the cable 14 follows. In the example shown, the direction 27 is curved. Its curvature is defined to limit that of the cable 14. In the scope of the invention, this direction may also be straight. A section of the fairlead 20 is defined in a plane perpendicular to the direction 27.

The fairlead 20 comprises:

- a movable bolt 30 closing a section of the sector 24,
- a force sensor 32 that is situated in front of the bolt 30 in one sense 34 of the main direction and is configured to detect an external force, and
- a trigger 36 configured to open the bolt 30 when a force exerted on the sensor 32 and oriented along the main axis in the sense 34 exceeds a predetermined force, and to close the bolt 30 when this force ceases.

In FIG. 4, the sense 34 corresponds to the raising of the towfish 12 toward the winch 16. The predetermined force corresponds to that exerted by the arms 12*a* and 12*b* when they come into contact with the force sensor 32. Advantageously, the force sensor 32 can likewise detect a force in the sense opposite to the sense 34 and the trigger likewise opens the bolt 30 when the force detected by the force sensor 32 in the opposite direction exceeds the predetermined force, and closes the bolt 30 when this force ceases. Thus, the bolt 30 opens and closes when the towfish 12, and more specifically each of the arms of the towfish 12, passes through the fairlead 20, both when it is raised toward the winch 16 and when it is lowered into the water.

When the fairlead comprises several sectors 23 and 24, as in the example shown, the fairlead 20 may advantageously comprise its own automatic opening mechanism associated with each sector. The automatic opening mechanisms of each of the sectors 23 and 24 can function simultaneously. The triggering of the opening then takes place with the aid of a force sensor shared by the different mechanisms. Alternatively, the different mechanisms function independently of one another, each having its own force sensor. This independence makes it possible to reduce the opening time of the different bolts as far as possible in order to best safeguard the cable 14 inside the fairlead 20.

Figure 5A:
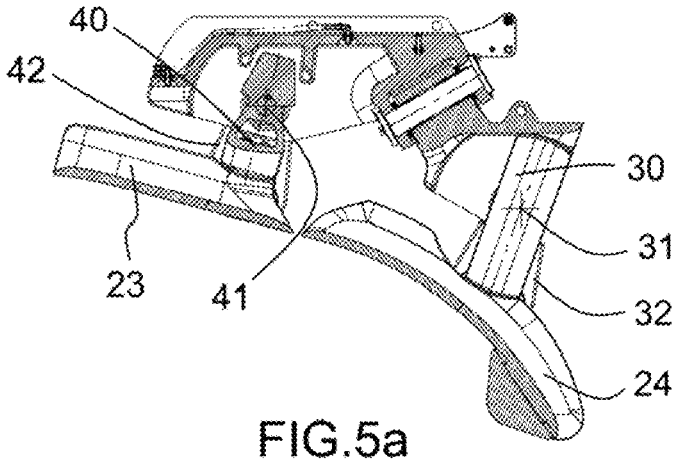
FIGS. 5*a*, 5*b* and 5*c* show the fairlead in profile in different positions of the automatic opening mechanism from FIG. 4.
Figure 5B:
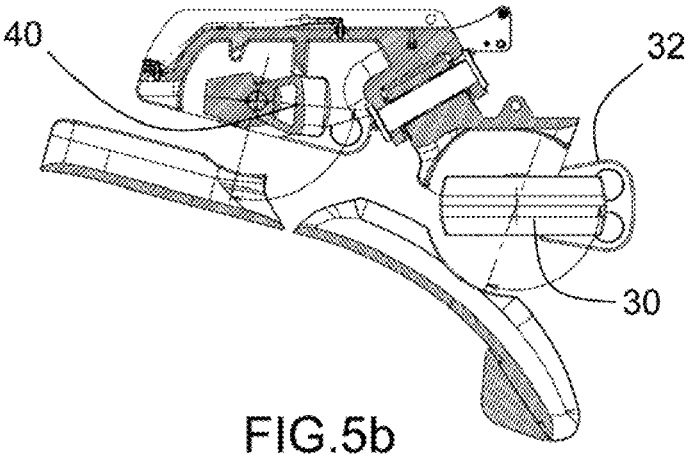
Figure 5C:
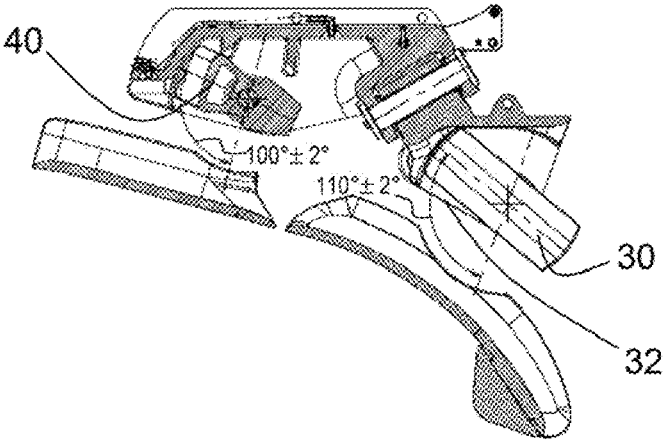

FIGS. 5*a*, 5*b* and 5*c* show the fairlead 20 in profile in different positions of the automatic opening mechanisms associated with each sector 23 and 24. In these figures, the bolt 30 and the force sensor 32 of the sector 24 and also a bolt 40 and a force sensor 42 that are associated with the sector 23 can be seen. In FIG. 5*a*, the bolts 30 and 40 are closed, in FIG. 5*b*, the bolts 30 and 40 are open so as to allow the towfish 12 to pass through in the direction of the sea, and in FIG. 5*c*, the bolts 30 and 40 are open so as to allow the towfish 12 to pass through in the direction of the winch 16. In the variant shown, the bolts are rotatable about an axis, 31 for the bolt 30 and about an axis 41 for the bolt 40.

Figure 6:
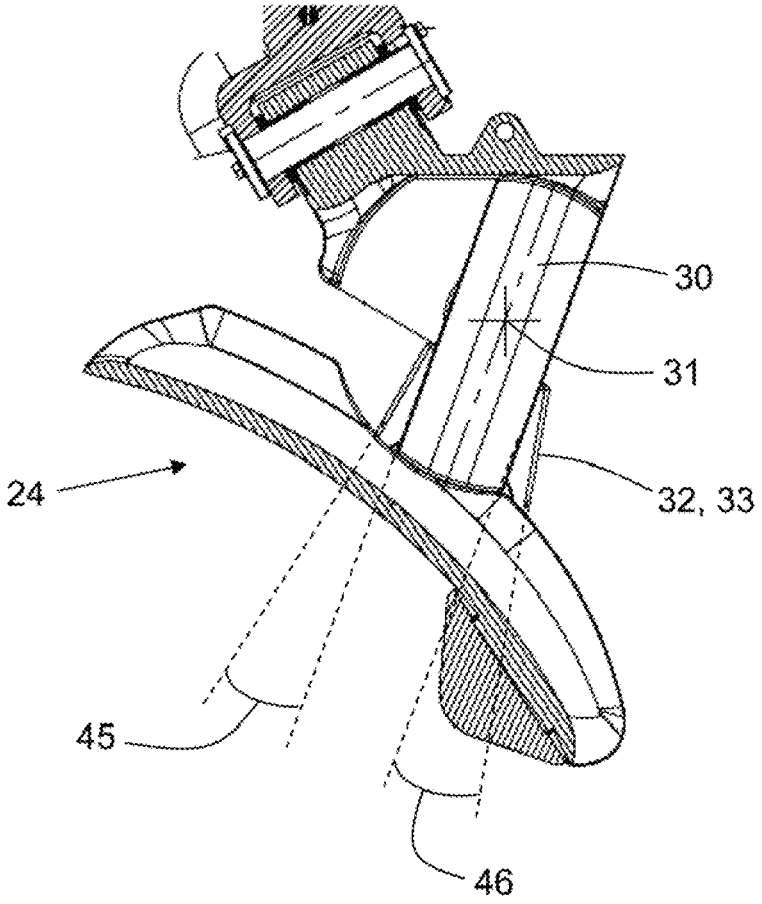
FIG. 6 shows the automatic opening mechanism from FIG. 4 in more detail.

FIG. 6 shows the sector 24 and the automatic opening mechanism thereof in more detail. The force sensor 32 comprises a tab 33 that is rotatable about the axis of rotation 31. The force sensor 32 makes it possible to detect a force in front of the bolt 30 in the direction of movement in question for the cable 14. In other words, when one of the arms 12*a* or 12*b* approaches the automatic opening mechanism, contact is made with the tab 33 which is situated in front of the bolt 30. Thus, there is no contact with the bolt 30 itself. This is because such contact could hamper the opening thereof and lead to deterioration of the bolt 30 and of the arm 12*a* or 12*b*. In FIG. 6, the movement of the tab 33 in the two possible senses of movement of the cable 14 can be seen. The movement is for example through an angle of around ten degrees: movement 45 when the towfish 12 passes through the fairlead 20 in the direction of the sea and movement 46 when the towfish 12 passes through the fairlead 20 in the direction of the winch 16. Other forms of tab 33 are likewise possible and the movement can be defined linearly. The automatic opening mechanism of the sector 23 is realized in a similar manner to the mechanism of the sector 24 with its movements in the two senses of circulation of the cable 14 in the fairlead 20.

Figure 7:
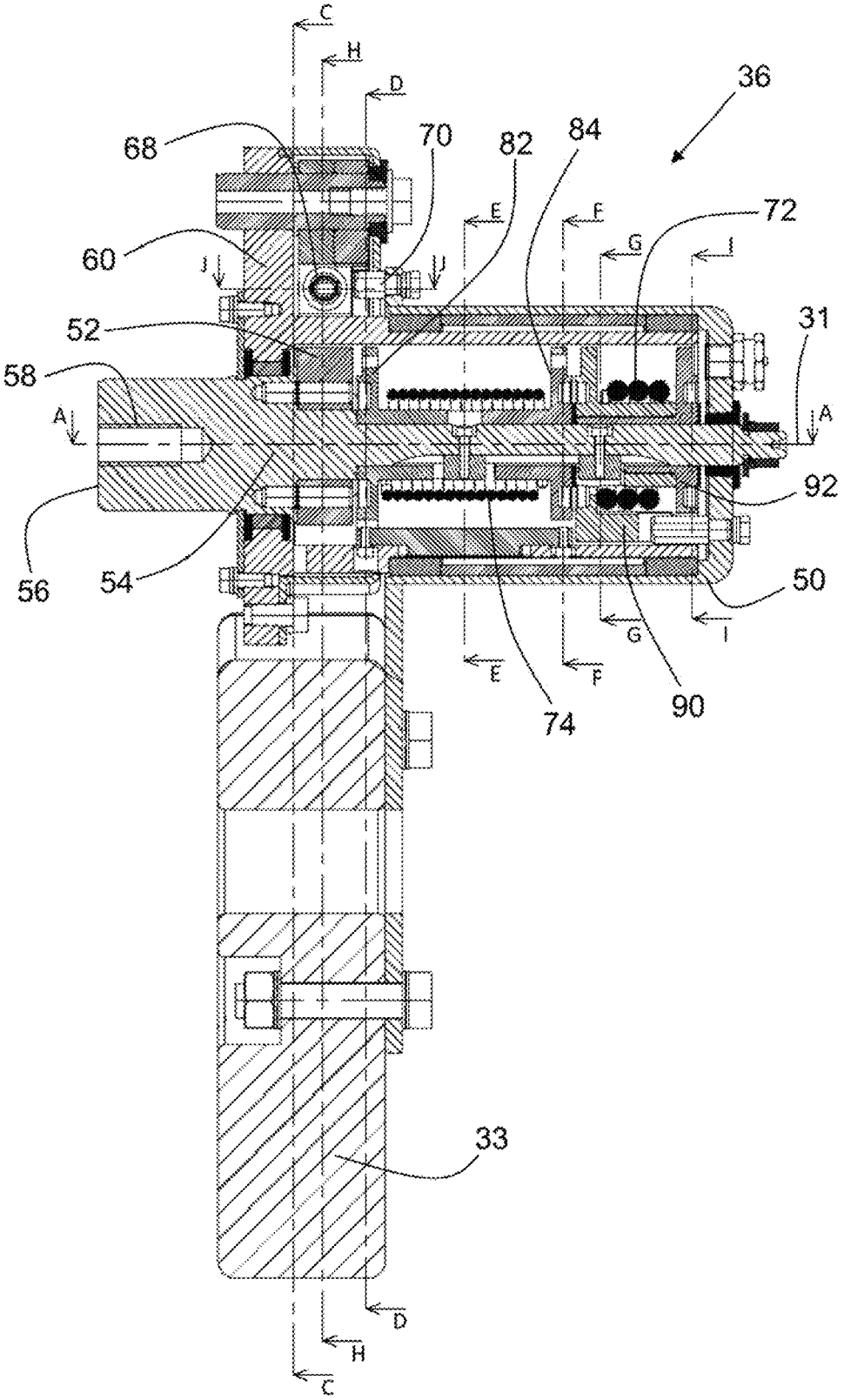
FIGS. 7, 8, 9 and 9*a* show the automatic opening mechanism from FIG. 4 in cross section.

FIG. 7 shows the automatic opening mechanism in cross section through the axis 31.

The trigger 36 is situated inside a shell 50 secured to the tab 33. The trigger 36 mainly comprises a pawl 52 that can take up three positions: a position in which the bolt 30 is closed, as shown in FIG. 5*a*, and two open positions in which the bolt 30 is open, as shown in FIGS. 5*b* and 5*c*. The closed position is effective when there is no force on the tab 33, and the open positions are achieved when a force greater than a predetermined force in one of the two senses of the main axis 27 is exerted on the tab 33. The pawl 52 may have only one open position if a pressing force on the tab 33 is detected only in one sense.

Figure 8:
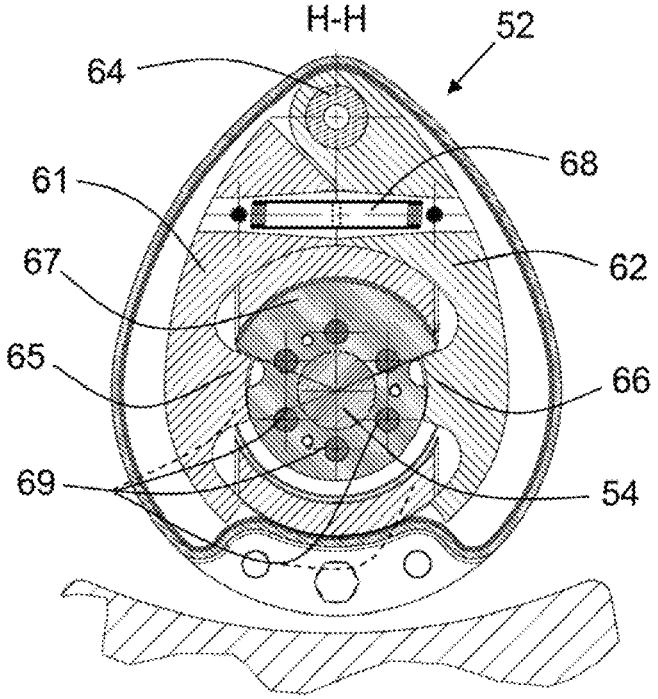
Figure 9:
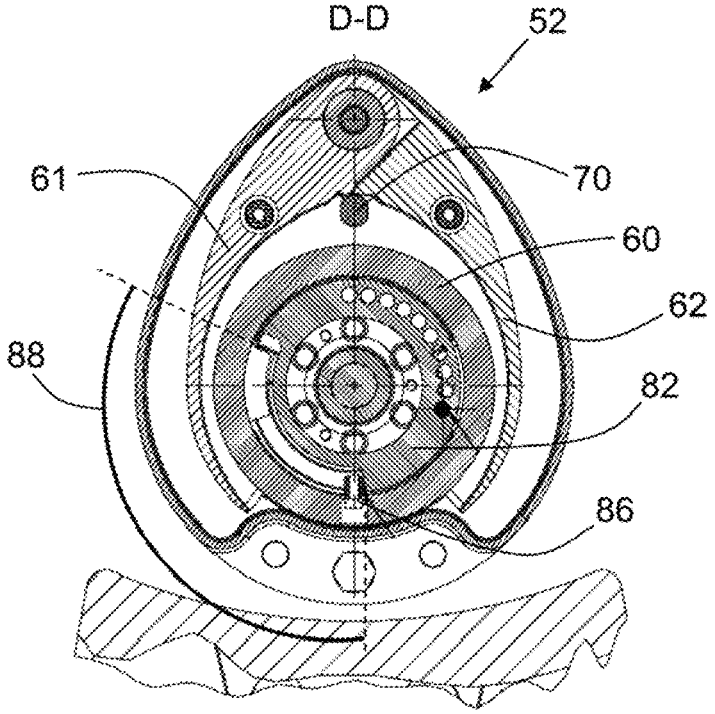

The pawl 52 is likewise visible in the cross sections HH and DD shown in FIGS. 8 and 9. The section planes HH and DD are perpendicular to the axis 31 and their position is identified in FIG. 7.

The automatic opening mechanism has a shaft 54 extending along the axis 31. The shaft is fixed to the bolt 30 (not shown in FIG. 7). One of the ends 56 of the shaft 54 may be grooved to ensure the positioning of the mechanism with the bolt 30. The mechanism and the bolt 30 can be held in position by means of a thread 58. Any other means for positioning and keeping in position is of course possible. The mechanism comprises a frame 60 fixed to the sector 24. The bolt 30 and the tab 33 are rotatable about the axis 31 with respect to the frame 60 and thus with respect to the sector 24.

The pawl 52 comprises two fingers 61 and 62 that are rotatable with respect to the frame 60 about an axis 64. The fingers each have a hook: 65 for the finger 61 and 66 for the finger 62. When the pawl 52 is in the closed position as shown in FIG. 8, the hooks 65 and 66 come into abutment against the shaft 54. Thus, the bolt 30 is immobilized with respect to the frame 60 and cannot move with respect to the sector 24. The pawl 52 comprises a spring 68 that keeps the two fingers 61 and 62 in abutment with the shaft 54. The hooks 65 and 66 can come into direct abutment with the shaft 54 or advantageously with a cam 67 joined to the shaft by screws 69 forming mechanical weak links. In normal operation, the cam 67 and the shaft 54 are secured to one another. If the automatic opening mechanism fails, the screws 69 can break and release the cam 67, which can then turn with respect to the shaft 54. Failure may be for example due to the fingers 65 and 66 seizing against the cam 67, preventing the bolt 30 from opening, even if the force on the force sensor exceeds the predetermined threshold for opening.

During a rotary movement of the tab 33, a pin 70, secured to the tab 33, makes it possible to open the pawl 52 by moving away one of the fingers 61 and 62. In practice, the pin 70 is fixed to the shell 50, which is itself fixed to the tab 33.

Figure 9A:
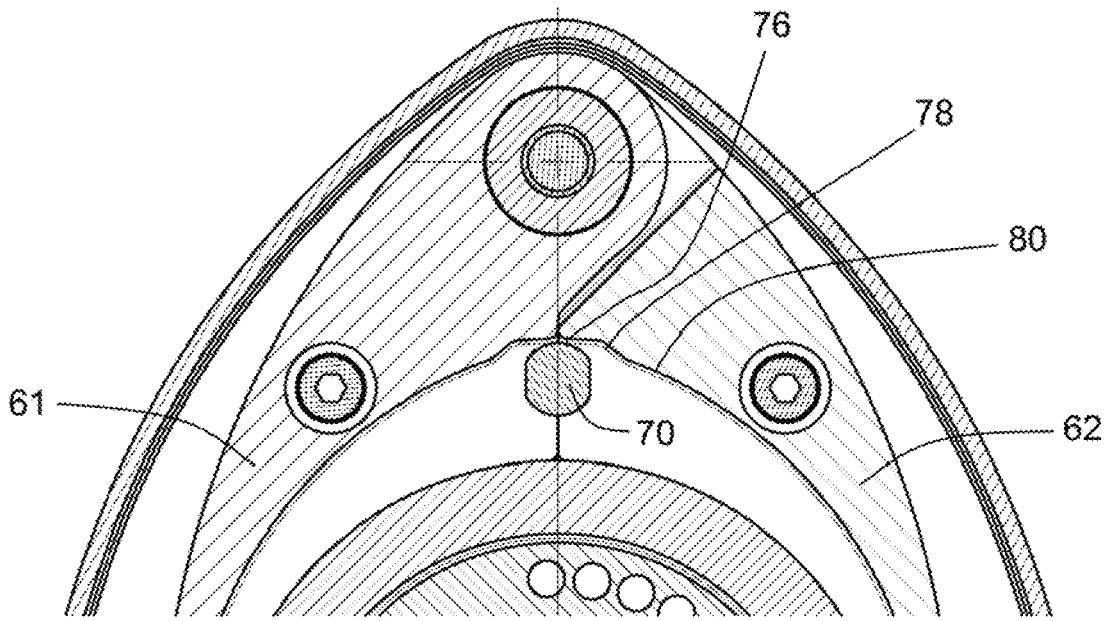

Moreover, a first spring 72 opposes the rotation of the tab 33 with respect to the bolt 30, which is fixed in the closed position of the pawl 52. Moreover, in addition to the spring 72, the internal shape of the fingers 61 and 62 against which the pin 70 presses and the shape of the hooks 65 and 66 are configured to define the force above which the pawl 52 opens in order to release the bolt 30. FIG. 9*a* is an enlarged part of FIG. 9 in which it is possible to see the shape of the fingers 61 and 62 in the vicinity of the point of equilibrium in which no force is exerted on the tab 33. When pressure is applied to the tab 33, the pin 70 moves, pushing for example the finger 62. At the start of travel, the internal shape of the finger is substantially flat so as not to bring about any movement of the finger 62. This flat zone bears the reference 76. Next, as its travel continues, the pin 70 reaches an inclined shoulder 78, forcing the finger 62 to move away from the shaft 54. The hook 66 is released from its abutment. It is during the passage of this shoulder that the bolt 30 is released. While continuing its travel, the pin 70 reaches a substantially circular zone 80 about the shaft 54. In this zone, the hook 66 is kept at a distance from its abutment. The internal shapes of the other finger 61 are for example symmetric. Asymmetric forms are possible, in particular to offset the movement in one sense with respect to the other or to obtain different forces to be applied by one of the arms 12*a* or 12*b* of the towfish 12 in one sense and in the other. A difference in force can be useful since, when lowering toward the sea, only the drag force of the streamer 30 drives the towfish, whereas, while the towfish is being raised, the winch 16 can exert a greater force. Moreover, while the towfish 12 is being raised, the fairlead 20 and thus the tab 33 are likely to ship seawater. Consequently, it is useful to differentiate the predetermined force values to be exerted on the tab 33 to open the bolt 30 on raising the towfish 12, corresponding to the sense 34, and on lowering the towfish, corresponding to the opposite sense. The predetermined force value for the sense 34 is thus advantageously greater than the predetermined force value for the opposite sense.

It is likewise possible to differentiate the force necessary for opening the pawl 52 in the two senses of rotation by doubling the spring 72, one acting in one sense and the other acting in the other sense. For each of the two springs, it is possible to choose different spring stiffnesses and different preloads.

Once the pawl 52 is open, the shapes thereof no longer prevent the rotation of the bolt 30. The spring 72 then applies a return action on the bolt 30 in order to realign the bolt 30 with the tab 33 and thus to prevent contact between the arm 12*a* or 12*b* and the bolt 30.

Advantageously, the mechanism comprises a second spring 74, which is connected between the frame 60 and the first spring 72 and tends to close the bolt 30, which is secured at the common point between the two springs 72 and 74. By choosing a spring stiffness of the second spring 74 that is less than that of the first spring 72, it is possible to limit the force necessary to completely open the mechanism and to maintain a high triggering force of the pawl 52 and thus to maintain the minimum force to be exceeded in order to trigger the opening of the bolt 30. Disposing the two springs 72 and 74 in series between the frame 60 and the tab 33 with the bolt 30 fixed at the common point of the two springs 72 and 74 makes it possible to maintain an angular offset between the tab 33 and the bolt 30 and thus to avoid any contact between the arm 12*a* or 12*b* and the bolt 30.

The two springs 72 and 74 are preloaded so as to allow the return toward the closed position when the pressure on the tab 33 stops. It is possible to regulate the preload and the spring stiffness of the spring 74 to a value lower than that of the spring 72 in order to further reduce the force necessary to reach the open position of the bolt 30.

Alternatively, it is possible to use only one spring that applies a return force to the bolt 30 with respect to the frame 60 and a return force to the tab 33 with respect to the frame 60. However, the use of one spring (per sense) has the drawback of leaving the tab 30 free during the opening of the pawl 52 and it is one of the arms of the towfish that pushes against the bolt 30 after the pawl 52 has been unlocked. Moreover, this variant, for one and the same predetermined force for triggering the opening of the bolt 30, results in a force necessary for complete opening, shown in FIG. 5*b* or 5*c*, that is greater than the triggering force in the variant with two springs (per sense), and a larger size of the spring in order to accept the opening amplitude.

The spring 74 is preloaded between two flanges 82 and 84 that are free to rotate with respect to the frame 60, in each case in an angular sector giving the possible angular travel for the bolt 30 in one of the senses of rotation. The balanced position is visible in FIG. 9, where the flange 82 is in abutment against a key 86 fixed to the frame 60. The flange 82 comprises a free angular sector 88 allowing it to turn with respect to the frame 60 during the rotation of the bolt 30 in one of the senses of rotation. In the example shown, the maximum rotation of the bolt 30 is 110°. A maximum rotation value of around 90° or slightly greater allows the bolt 30 to be retracted sufficiently during the passage of the arms of the towfish 12. The flange 84 comprises a similar angular sector allowing the rotation of the bolt 30 in the other sense of rotation. The free angular sectors of the flanges 82 and 84 may be different depending on the maximum travels desired for the bolt 30 in the two senses of rotation.

Just like the spring 72, it is possible to double the spring 74 in order to differentiate the spring stiffness and the preload in the two senses of circulation of the cable 14 in the fairlead 20.

Figure 10:
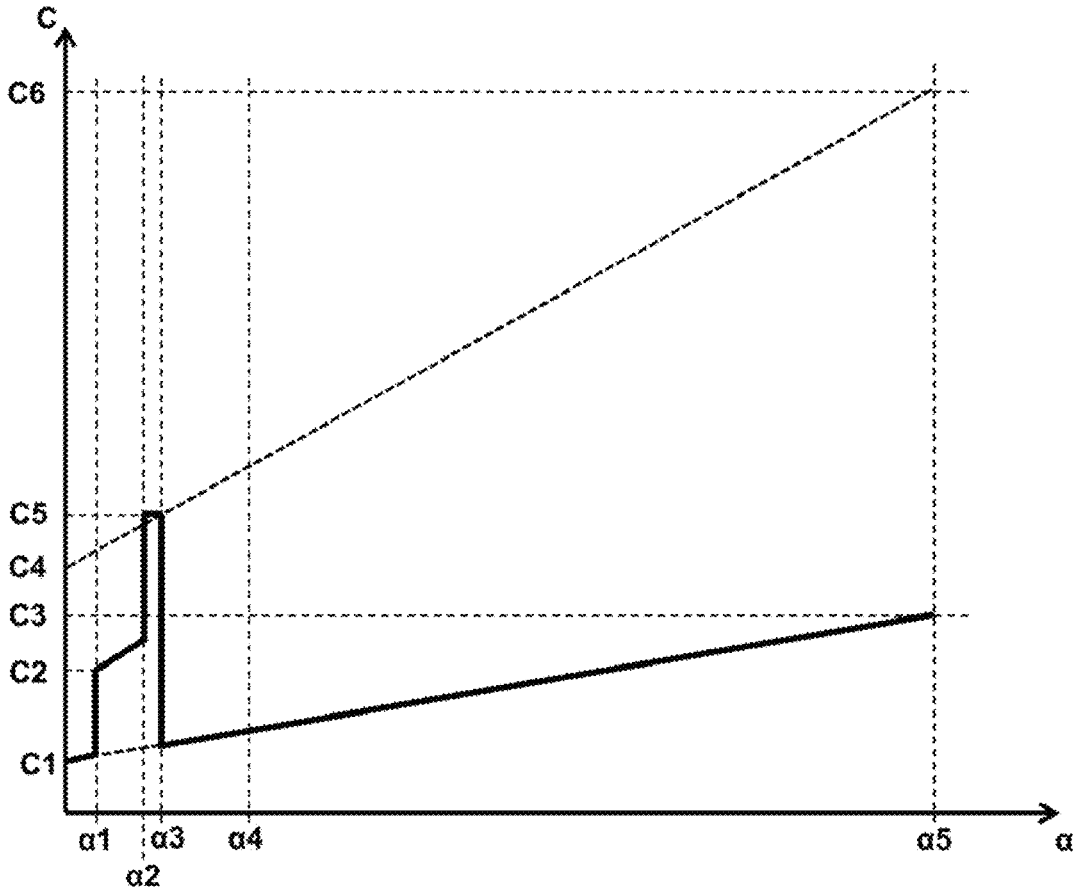
FIG. 10 shows the variation in force on a tab of the mechanism from FIG. 4 as a function of the travel of the tab.

FIG. 10 shows, in the form of a curve, the force applied to the tab 33 as a function of the movement thereof in one of the senses of the main direction 27. In practice, the springs 72 and 74 are torsion springs in the variant shown, and the force is given in the form of a torque denoted C. In addition, with the tab 33 moving in rotation, the movement thereof is expressed as an angle denoted a. A functional clearance $\alpha$1 of for example around 1° is provided between the cam 67 and the pawl 52, more specifically between the fingers 65 and 66 and the cam 67. This clearance makes it possible to ensure that the pawl 52 returns into the closed position and thus that the bolt 30 returns into the closed position. A torque C1 represents the preload of the spring 74. At the start of the movement of the tab 33 on account of a pressure in one of the two senses of the main direction 26, the functional clearance $\alpha$1 is taken up by a tension of the spring 74. Once this clearance has been taken up, the pawl 52 bears against the cam 67 and the torque necessary for rotation of the tab 33 is the preload torque C2 of the spring 72, which is greater than the torque C1, hence the vertical part of the curve between the torques C1 and C2 for the angular position $\alpha$1. Beyond the position $\alpha$1, the pin 70 travels through the flat zone 76 and the spring 72 is tensioned from a preload C2 until reaching a position $\alpha$2 of for example around 2.5°. In this position, the pin 70 comes into contact with the shoulder 78. The gradient of the curve between the positions $\alpha$1 and $\alpha$2 is substantially given by the spring stiffness of the spring 72. Next, the pin 70 moves over the shoulder 78 and the curve becomes substantially vertical so as to achieve the predetermined triggering force C5 to be exceeded in order to release the rotation of the bolt 30 and thus allow it to open. The force C5 is achieved for example for an angular position $\alpha$3 of 3°, which is less than the movement of the tab 33 with respect to the bolt 30. This movement is depicted in FIG. 10 by an angular position $\alpha$4 of for example around 10°. Thus, the bolt 30 opens before the object (in this case the towfish) that has triggered its opening reaches it.

Between the balanced position where $\alpha$=0° and the position $\alpha$3, the tab 33 moves angularly without the bolt 30 turning. When the bolt 30 is released, the latter is realigned with the tab 33. In other words, beyond the position $\alpha$3, the tab 33 returns to the advanced position that it had on the bolt 30 in the rest position for $\alpha$=0° in order to prevent any contact between the arm 12*a* or 12*b* and the bolt 30. The spring stiffness of the spring 72 contributes to the realignment of the bolt 30 and the tab 33.

Following the opening of the bolt 30, the curve in FIG. 10 returns to a lower value and follows a moderate gradient given by the spring stiffness of the second spring 74. The descent of the curve is due to the transition between the zones 78 and 80 of the finger 62 and to the releasing of the hook 66 which was rubbing against its abutment with the shaft 54. The preload C1 of the second spring 74 is, in the example shown, less than the preload C2 of the first spring 72. Alternatively, it is possible for the first spring 72 not to be preloaded provided that its spring stiffness is high enough for its return torque to exceed the preload torque C1 of the second spring 74 for the angular position $\alpha$2.

Beyond the position $\alpha$3, the rotation of the tab 33 continues as far as the position $\alpha$5, for example around 110°, in which position the return torque C3 is substantially a function of the spring stiffness of the second spring 74.

The variant with one spring (per sense) is also depicted by dashed lines in FIG. 10. Starting from a preload C4, the single spring is tensioned until it reaches a torque C6 for the position $\alpha$5. The torque C6 arises from the spring stiffness of the single spring and from the minimum torque C5 desired for the torque upon the opening of the mechanism at the position $\alpha$3. The variant with one spring results in a value C6 that is much greater than the value C3 if the spring stiffness of the spring is high. It is possible to choose, for this single spring, a lower spring stiffness (gradient less pronounced for the dashed curve), but this requires a very large increase in size.

The curve is substantially symmetric with respect to the y-axis give or take the adaptations described above, the maximum torque value C5 and angular amplitude which can be adjusted differently in the two senses of rotation. Thus, the bolt 30 tends to return to its closed balanced position regardless of its sense of rotation.

Returning to the variant with two springs 72 and 74, when the force on the spring 33 ceases, the tab 33 and the bolt 30 close, following a direct curve from the point on the curve ($\alpha$5, C3) to the point (0, C1) and then (0,0). The preload C1 of the second spring 74 ensures the closure of the bolt 30 and the return of the pin 72 to its balanced position.

The return of the tab 33 with respect to the shaft 54 takes place in a similar manner to that of the bolt 30 with respect to the frame 60. The spring 72 is preloaded between two flanges 90 and 92 that are rotatable with respect to the shaft 54. The flange 90 is coupled to the shaft 54 via a key and the flange 92 is coupled to the shell 50 and thus to the tab 33 via a pin. The angular travel of the flange 90 is around 10° with respect to the shaft 54, and corresponds to the movement 45 and 46 of the tab 33 with respect to the bolt 30; it can be ensured, as above, by means of a key fixed to the shaft 54 and a free angular sector realized in the flange 90.

Figure 11:
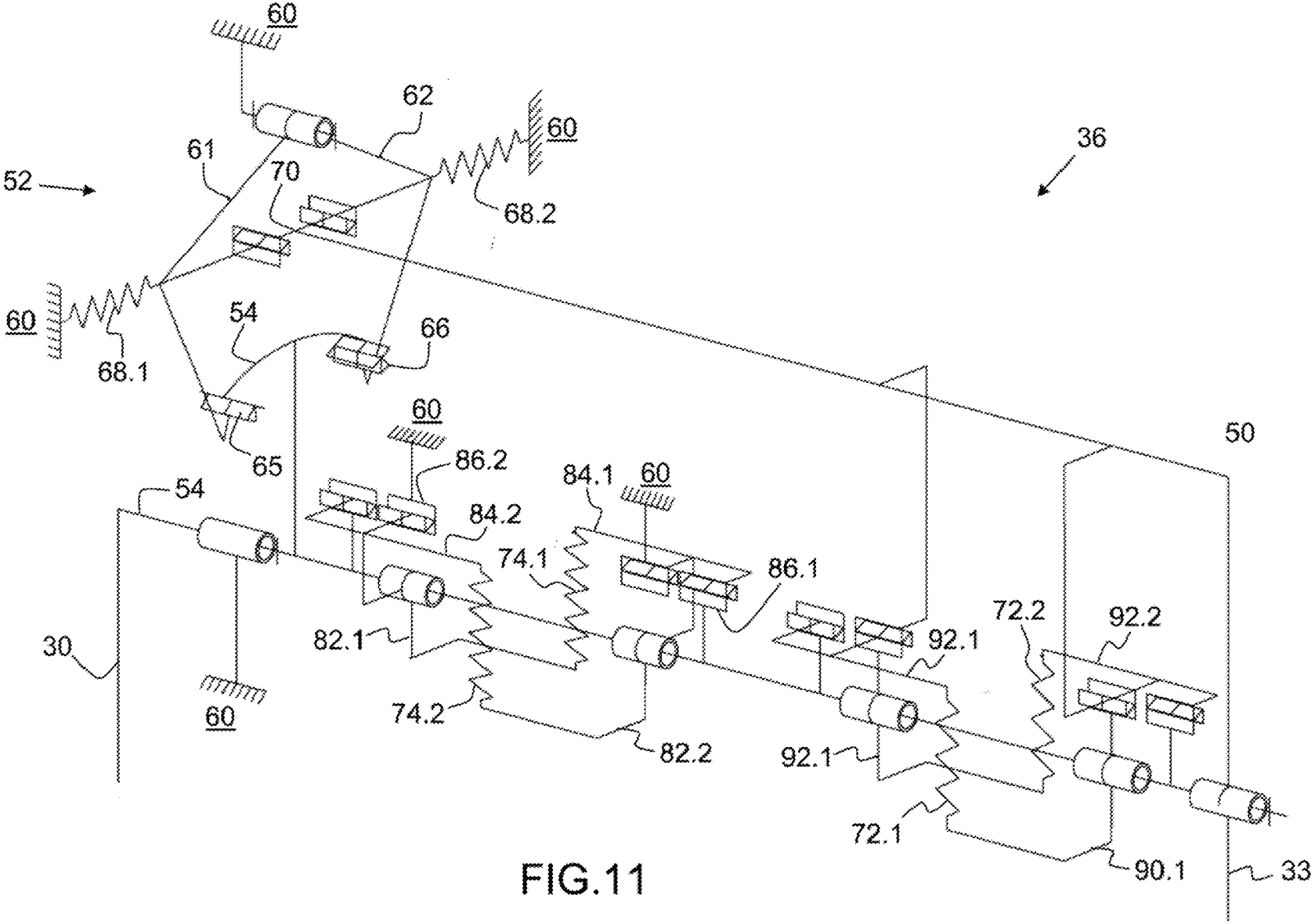
FIG. 11 shows a kinematic diagram of the first embodiment.

FIG. 11 shows a kinematic diagram of the first embodiment. This diagram shows several variants with respect to the depictions in cross section in FIGS. 7 to 9. More specifically, in FIGS. 7 and 8, a spring 68 that tends to return the two fingers 61 and 62 into abutment against the shaft 54 via hooks 65 and 66 can be seen. In the kinematic diagram in FIG. 11, the spring 68 has been replaced by two springs 68.1 and 68.2. The spring 68.1 is disposed between the finger 61 and the frame 60. The spring 68.1 tends to return the finger 61 into abutment with the shaft 54. Similarly, the spring 68.2 is disposed between the finger 62 and the frame 60. The spring 68.2 tends to return the finger 62 into abutment with the shaft 54. This doubling of the spring 68 makes it possible to differentiate the force necessary for opening the pawl 32 in the two senses.

The pin 70 secured to the shell 50 and the tab 33 appears in the diagram in FIG. 11. The contact that the pin 70 can exert on one of the fingers 61 or 62 is shown in the form of a rectilinear link. A punctiform link is likewise conceivable. It is clear that the pin 70 exerts only one contact at a time, either on the finger 61 or on the finger 62. Consequently, only one of the rectilinear links is effective at a time, the other being absent.

In the kinematic diagram in FIG. 11, the springs 72 and 74 have likewise been doubled as mentioned above. For one of the senses, the function ensured by the spring 72 is ensured by the spring 72.1 held between the two flanges 90.1 and 92.1. For the other sense, the function ensured by the spring 72 is ensured by the spring 72.2 held between the two flanges 90.2 and 92.2.

Similarly, for one of the senses, the function ensured by the spring 74 is ensured by the spring 74.1 held between the two flanges 82.1 and 84.1. For the other sense, the function ensured by the spring 74 is ensured by the spring 74.2 held between the two flanges 82.2 and 84.2. The key 86 secured to the frame 60 is likewise doubled and shown in FIG. 11. The flange 82.1 bears against the key 86.1. The flange 82.2 bears against the key 86.2. These bearings are shown schematically in the form of rectilinear links that it is possible to lose when the corresponding flange turns with respect to the shaft 54, as for example in the free angular sector 88 for the flange 82, as visible in FIG. 9. Simple punctiform links can likewise replace the different rectilinear links.

Figure 12:
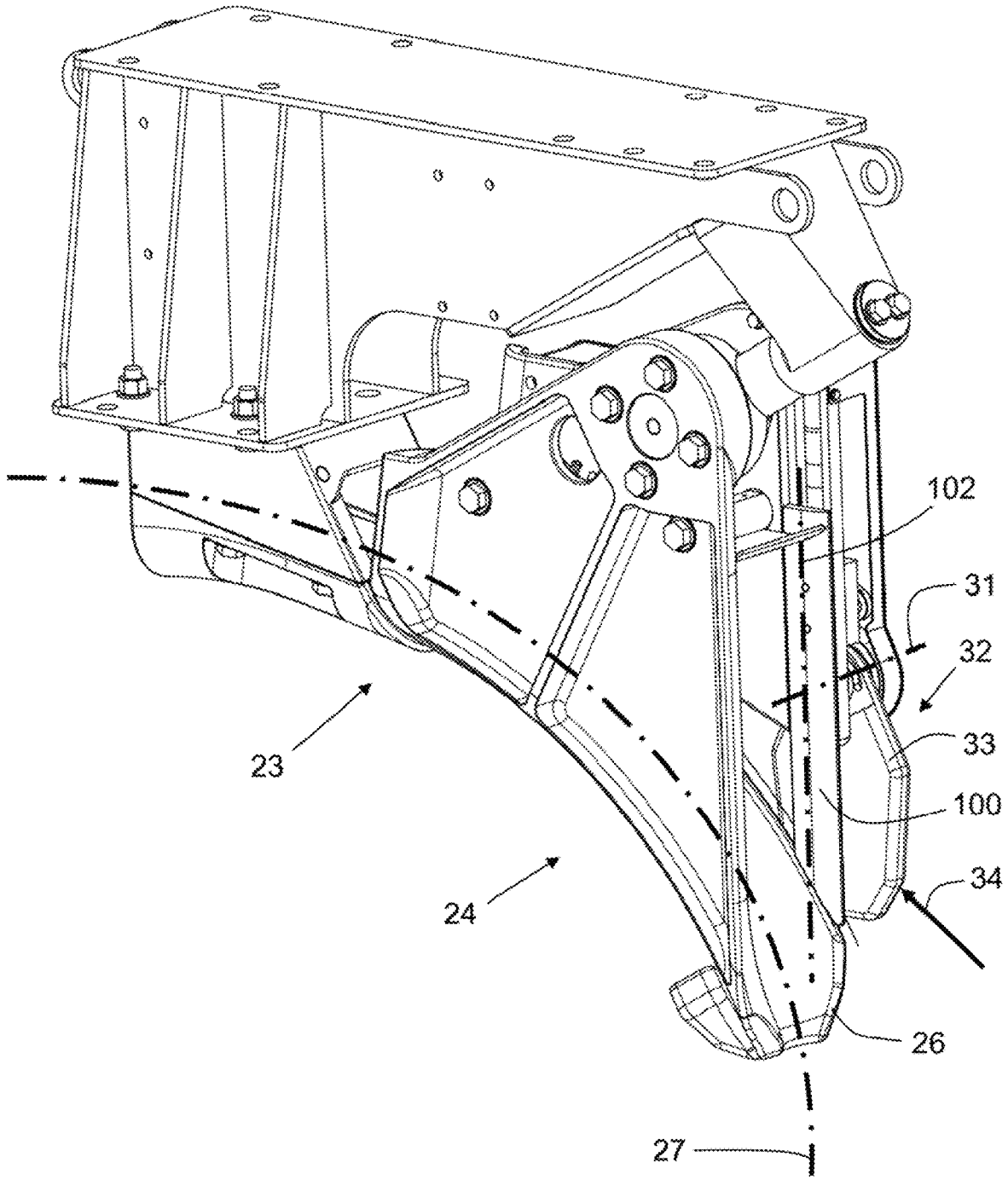
FIG. 12 shows a perspective view of a second embodiment of a mechanism for automatically opening the fairlead.

FIG. 12 shows a perspective view of a second embodiment of a mechanism for automatically opening the fairlead 20. The two sectors 23 and 24 are apparent. It is clear that this second embodiment can be implemented in a fairlead with one sector.

In the second embodiment, the tab 33 for detecting a force is apparent. A bolt 100 which, unlike the first embodiment, opens and closes in a movement in translation along an axis 102, is apparent. The bolt is guided in translation with respect to the sector 24 along the axis 102.

Figure 13:
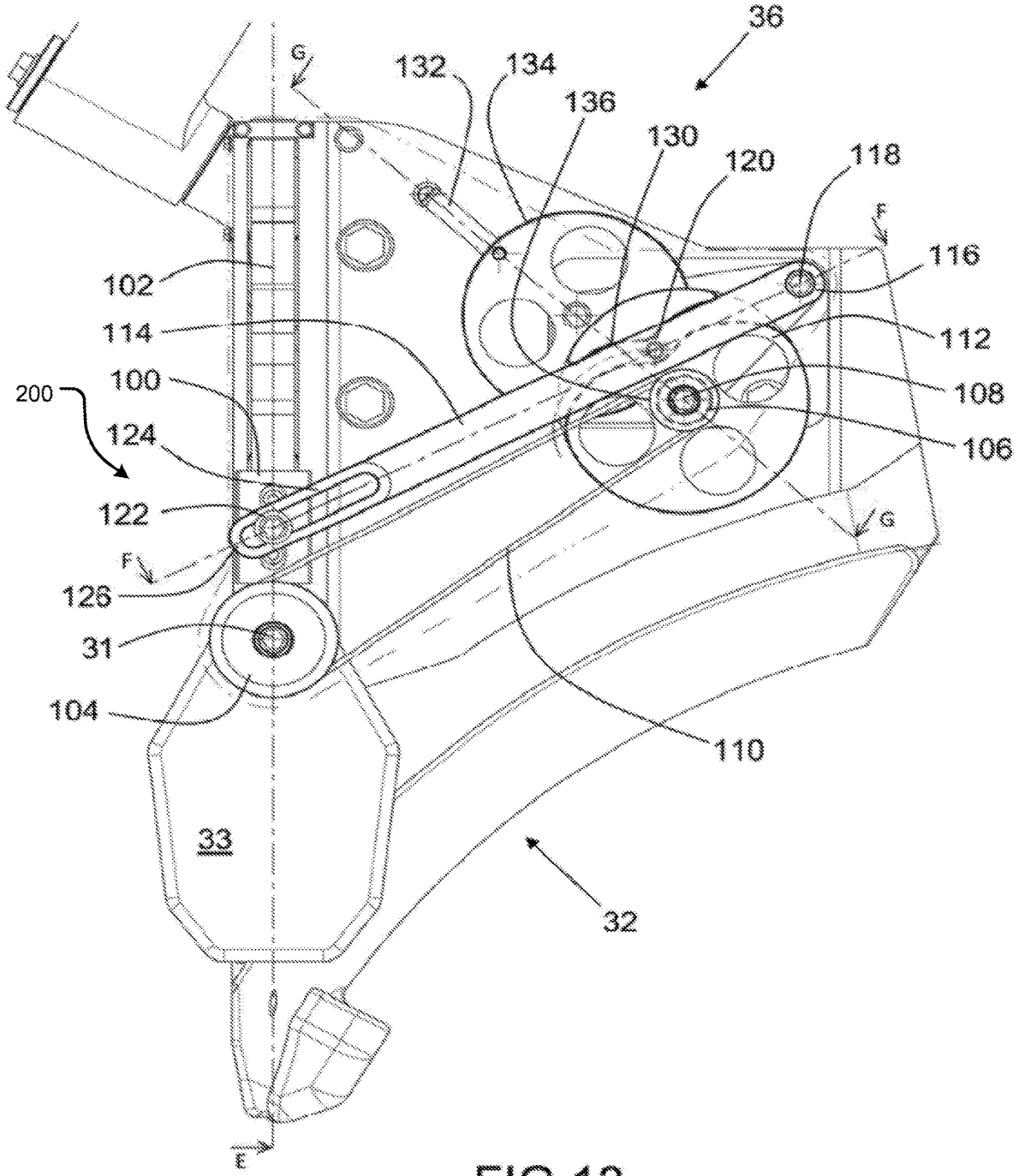
FIG. 13 shows a side view of the automatic opening mechanism of the second embodiment.

FIG. 13 shows a side view of the automatic opening mechanism of the second embodiment. The tab 33, as before, is rotatable about the axis 31 with respect to the sector 24. As before, the force sensor 32 detects a force in front of the bolt 30 in the sense of movement in question for the cable 14. This movement is clear in FIG. 12, where the tab 33 protrudes from the bolt 100 in at least one of the senses of the main direction 27 followed by the cable 14 in the sector 24. In the example shown, the tab 33 protrudes from the bolt 100 in both senses. The external shape of the tab 33 against which the arms of the towfish 12 are intended to press can define the movement with respect to the bolt 100.

A pinion 104 is secured to the tab 33. The pinion 104 turns about the axis 31. A second pinion 106 is rotatable with respect to the sector 24. The axis of rotation 108 of the pinion 106 is different from the axis of rotation 31 of the pinion 104. The pinion 106 is driven by the pinion 104 via a belt 110. The tab 33, the pinions 104 and 106 and the belt fulfill the function of the force sensor 32.

A cam 112 is secured to the pinion 106. An arm 114 can pivot at one of its ends 116 with respect to the sector 24 about an axis 118 different from the axes of rotation 31 and 108 of the two pinions 104 and 106. The arm 114 comprises a roller 120 that forms a cam follower and presses on the cam 112. The bolt 100 comprises a pin 122 that can slide in a slot 124 made in the arm 114 at its second end 126. The cam 112, the arm 114 and the roller 120 fulfill the function of the trigger 36.

The arm 114 forms a lever for moving the bolt 100 in translation along its axis 102. The shape of the cam 112 is defined to coordinate the movement in translation of the bolt 100 depending on the angular movement of the tab 33. The distance ratio between the pin 122 and the axis of rotation 118, for the one part, and the roller 120 and the axis of rotation 118, for the other part, makes it possible to amplify the movement in translation of the bolt 100 with respect to the rotation of the tab 33. This amplification can be modified by the ratio of the diameters of the pinions 104 and 106. In the example in question, the pinions 104 and 106 and the arm 114 amplify the movement in translation of the bolt 100. A reduction is likewise conceivable.

Any other means for converting 200 the rotary movement of the tab 33 into a movement in translation of the bolt 100 is possible within the scope of the invention, for example a system of the rod-crank type.

In order to avoid a situation in which the roller 120 loses contact with the cam 112, the latter advantageously comprises a groove 130 in which the roller 120 moves. The roller 120 thus remains in contact with the two flanks of the groove 130.

The profile of the cam 112 against which the roller 120 bears is advantageously defined such that the mechanism is irreversible, i.e. a force on the bolt 100 cannot open it. This makes it possible to prevent friction of the cable on the bolt 100 being able to raise it. Thus, only a force on the tab 33 that tends to pivot it about its axis 31 makes it possible to open the bolt 100.

The profile of the cam 112 is symmetric with respect to the point of equilibrium shown in FIG. 13. This point of equilibrium corresponds to the bottom position of the bolt 100, in which it closes the sector 24. The symmetric shape of the cam 112 allows identical movements of the bolt 100 depending on the rotation of the tab 33 in the two senses of the direction 27. It is possible to provide different shapes for each of the two senses depending on the desired movements for the bolt 100.

The mechanism comprises a return spring 132 that tends to keep the bolt 100 in the closed position. A preload of the spring 132 makes it possible to define the minimum force to be exerted on the tab 33 in order to open the bolt 100. The spring 132 can be directly fixed between the sector 24 and the bolt 100. This disposition of the spring 132 only functions if the mechanism is reversible. In the case of an irreversible mechanism, the spring 132 can be directly fixed between the sector 24 and the cam 112 in order to exert a torque on the cam 112, this torque tending to keep the roller 120 at the balanced position. In the example shown, in order to accentuate the effect of the spring 132, the mechanism comprises a crown wheel 134 that is rotatable with respect to the sector 24 and a pinion 136 secured to the cam 112. The crown wheel 134 and the pinion 136 roll without sliding on one another. To this end, the crown wheel 134 and the pinion 136 comprise for example cooperating gear teeth. With respect to the plane of FIG. 13, the pinion 136 is situated behind the cam 112, while the pinion 106 is situated in front of the cam 112. The spring 132 is fixed between the sector 24 and the crown wheel 134. The diameter ratio between the pinion 136 and the crown wheel 134 amplifies the return force of the spring 132.

The invention claimed is:

1. A fairlead that is configured for a towing device installed on a deck of a ship, the towing device comprising a winch, and a cable passing through the fairlead under an action of the winch, the fairlead comprising:

an open-section channel extending in a main direction for guiding the cable, wherein the fairlead also comprises:

a movable bolt closing a section of the open-section channel, a force sensor that is situated in front of the movable bolt with respect to the main direction and is configured to detect an external force, and a trigger configured to open the movable bolt when a force exerted on the force sensor exceeds a predetermined force, and the trigger is configured to close the movable bolt when the force ceases.

2. The fairlead as claimed in claim 1, wherein the force sensor is configured to detect an external force in front of the movable bolt in both directions along the main direction, and wherein the trigger is configured to open the movable bolt when a force exerted on the force sensor and oriented along the main direction in both directions exceeds the predetermined force, and the trigger is configured to close the movable bolt when the force ceases.

3. The fairlead as claimed in claim 1, wherein the movable bolt is rotatable with respect to the open-section channel about an axis of rotation substantially perpendicular to the main direction.

4. The fairlead as claimed in claim 3, wherein the force sensor comprises a tab that is rotatable about the axis of rotation, in that the trigger comprises a pawl that takes up two positions, of which:

a first position, referred to as a closed position, is implemented when there is no force on the tab and keeps the movable bolt closed, and a second position, referred to as an open position, allows the movable bolt to rotate freely, in that the pawl is driven by the tab from the closed position to the open position after the predetermined force has been exceeded, and the fairlead also comprising a first spring connected between the open-section channel and the tab, a spring stiffness of the first spring contributing to the predetermined force and to a realignment of the movable bolt with the tab.

5. The fairlead as claimed in claim 4, wherein the first spring is configured with a preload, the preload contributing to the predetermined force and to the realignment of the movable bolt with the tab.

6. The fairlead as claimed in claim 4, wherein the trigger comprises a second spring that tends to close the movable bolt, the second spring being connected in series with the first spring, and in that the movable bolt is secured at a common point between the first spring and the second spring.

7. The fairlead as claimed in claim 6, wherein the second spring has a spring stiffness less than the spring stiffness of the first spring.

8. The fairlead as claimed in claim 6, wherein the second spring is configured with a preload by a value less than the preload of the first spring.

9. The fairlead as claimed in claim 1, wherein the movable bolt is movable in translation with respect to the open-section channel along an axis substantially perpendicular to the main direction.

10. The fairlead as claimed in claim 9, wherein the force sensor comprises a tab that is rotatable about an axis of rotation substantially perpendicular to the main direction, and a cam and an arm pressing on the cam convert a rotary movement of the tab into a movement in translation of the movable bolt.

11. The fairlead as claimed in claim 10, wherein a profile of the cam is defined such that a movement in translation is irreversible.

12. The fairlead as claimed in claim 10, wherein the fairlead comprises a cam that turns with the tab and a pivoting lever comprising, at a distance from a pivot axis of the pivoting lever, a pin bearing on the cam and a slot in which the movable bolt is supported.

13. The fairlead as claimed in claim 12, wherein the fairlead comprises a return spring that tends to return the cam into a balanced position in which the movable bolt is closed.

14. A towing device configured for installation on a deck of a ship, the towing device comprising the winch, the cable, and the fairlead as claimed in claim 1, wherein the fairlead and the winch are fixed with respect to one another.

* * * * *